United States Patent [19]

Kalvinskas et al.

[11] 4,310,049

[45] Jan. 12, 1982

[54] CRUDE OIL DESULFURIZATION

[75] Inventors: John J. Kalvinskas, Pasadena; George C. Hsu, La Crescenta; John B. Ernest, Santa Ana, all of Calif.

[73] Assignee: California Institute of Technology, Pasadena, Calif.

[21] Appl. No.: 30,831

[22] Filed: Apr. 17, 1979

[51] Int. Cl.[3] ..... E21B 43/24; C10G 27/02

[52] U.S. Cl. ..... 166/267; 166/303; 208/241

[58] Field of Search ..... 166/75 R, 265, 266, 166/267, 272, 303; 208/241, 227, 228, 230

[56] References Cited

U.S. PATENT DOCUMENTS

| | | | |
|---|---|---|---|
| 1,263,618 | 4/1918 | Squires | 166/266 |
| 2,107,713 | 2/1938 | Rowland et al. | 208/241 |
| 2,503,486 | 4/1950 | Himel | 208/241 X |
| 2,582,148 | 1/1952 | Nelly, Jr. | 166/266 |
| 2,969,226 | 1/1961 | Huntington | 166/272 X |
| 3,660,512 | 5/1972 | Hamby et al. | 208/241 X |
| 3,844,349 | 10/1974 | Snavely, Jr. et al. | 166/272 |
| 3,881,550 | 5/1975 | Barry | 166/303 X |
| 4,007,786 | 2/1977 | Schlinger | 166/267 X |

OTHER PUBLICATIONS

Shreve, R. Norris, *Chemical Process Industries*, Third Edition, 1967, pp. 240–242.

*Primary Examiner*—Stephen J. Novosad
*Assistant Examiner*—George A. Suchfield
*Attorney, Agent, or Firm*—Marvin E. Jacobs

[57] ABSTRACT

High sulfur crude oil is desulfurized by a low temperature (25°–80° C.) chlorinolysis at ambient pressure in the absence of organic solvent or diluent but in the presence of water (water/oil=0.3) followed by a water and caustic wash to remove sulfur and chlorine containing reaction products. The process can be practiced at the well site for the recovery of desulfurized oil used to generate steam for injection into the well for enhanced oil recovery.

4 Claims, 2 Drawing Figures

CRUDE OIL DESULFURIZATION

ORIGIN OF THE INVENTION

The invention described herein was made in the performance of work under a NASA contract and is subject to the provisions of Section 305 of the National Aeronautics and Space Act of 1958, Public Law 83-568 (72 Stat. 435; 42 USC 2457).

TECHNICAL FIELD

The present invention relates to desulfurization of high sulfur crude oils.

BACKGROUND ART

Petroleum is still the primary feed stock for oil-fired burners for petroleum refineries, petrochemical industries, domestic power generation and for on-site production of steam for reinjection into a well for steam flooding which is a major Enhanced Oil Recovery (EOR) Process being successfully practiced in California and elsewhere.

However, there are very few instances of naturally occurring low-sulfur crudes (less than 0.5% sulfur) and the limited availability makes these crude oils very expensive. Combustion of high sulfur crudes leads to sulfur dioxide emissions at excessive levels which require expensive post-combustion scrubbing of the flue gas.

Pre-combustion desulfurization is an alternative. Sulfur removal from petroleum oil at the site is much more difficult than desulfurization of coal due to the unique organic-sulfur form of the impurity and the EPA requirement to reduce the sulfur content to about 0.3%. Whereas, some coals mainly contain pyritic sulfur of the inorganic type which can readily be removed by physical-chemical treatment, it is much more difficult to remove organic thiophenes from petroleum. Organic thiophenes are mainly liquids and tend to co-distil with the petroleum fraction if fractionation purification is attempted.

Hydrodesulfurization of petroleum crude oil with cobalt-molybdenum or nickel-molybdenum catalysts on an alumina support is a currently utilized desulfurization process. The requirements of catalysts, hydrogen consumption and severe reactor operating conditions render this process quite expensive. An urgent need for an economical, crude oil desulfurization process has been expressed by the petroleum industry in a recent survey.

STATEMENT OF INVENTION

A simple, low cost method of desulfurizing high sulfur petroleum crude oils has been provided in accordance with the present invention. The process has a low energy penalty, operating at very low temperature and ambient pressure, and can be carried out in simple apparatus with minimum capital cost for equipment at the drilling site and at other locations removed from the available refinery or process plant catalytic desulfurization installations.

High sulfur crude oil is desulfurized in accordance with this invention by a low temperature chlorinolysis of the oil at ambient pressure for a short period in the absence of organic solvent but in the presence of a minor amount of water followed by aqueous and caustic washes to remove the sulfur and chlorine containing by-products. 75 to 90% of the sulfur is removed in about one hour of treatment. Any process equipment having a chlorine-resistant surface may be utilized. The only process requirement appears to be adequate mixing of the oil and chlorine gas and an efficient means of introducing the chlorine gas.

These and many other attendant advantages of the invention will become readily apparent as the invention becomes better understood by reference to the following detailed description when considered in conjunction with the accompanying drawings.

DETAILED DESCRIPTION OF THE INVENTION

The high sulfur crude oils to be treated in the process of the invention are petroleum crude oils containing from 0.5% to 3% sulfur, generally about 1% sulfur. Chlorinolysis is conducted at a low temperature below 120° C., generally from 25° C. to 85° C. for at least 5 minutes and usually for less than 120 minutes. The ratio of water to crude oil should be at least 0.05/l and no more than 0.5/l. The water can be added as steam and separately bubbled through the crude. Chlorine gas is introduced at a rate of from 1 to 100 grams of $Cl_2$/100 grams oil/hr.

A brown emulsion results. The chlorinated crude is then treated with at least an equal volume of water at ambient temperature or slightly heated to a temperature from 20° C. to 80° C. and the water separated. The crude oil is then washed with at least an equal volume of caustic such as sodium hydroxide having a molarity of from 0.1 to 2.

The carbon-sulfur (sulfide) and sulfur-sulfur (disulfide) bonds of the organic sulfur components of crude oil are highly reactive due to high steric accessibility and electron releasing and demanding nature of the sulfur atom. Chlorine treatment in the presence of water brings about the scission of these bonds as follows:

$$R{-}S{-}R' + Cl^+ - Cl^- \xrightleftharpoons{H^+} RSCl + R'^+ + Cl^- \rightleftharpoons RSCl + R'Cl$$

$$R{-}S{-}S{-}R' + Cl^+ - Cl^- \xrightleftharpoons{H^+} RSCl + R'S^+ + Cl^- \rightleftharpoons RSCl + R'SCl$$

where R and R′ represent hydrocarbon groups.

The resulting chlorinated organo-sulfur compounds are oxidized and hydrolyzed in the presence of chlorine and water at moderate temperature to produce sulfate compounds as follows:

$$RSCl \xrightarrow{H_2O} RSO_2Cl \xrightarrow[\Delta]{H_2O,\ Cl_2} RCl + SO_4^{=}$$

Most of the sulfate compounds and chlorine compounds are removed by hydrolysis during the water and caustic washing steps.

Figure 1:
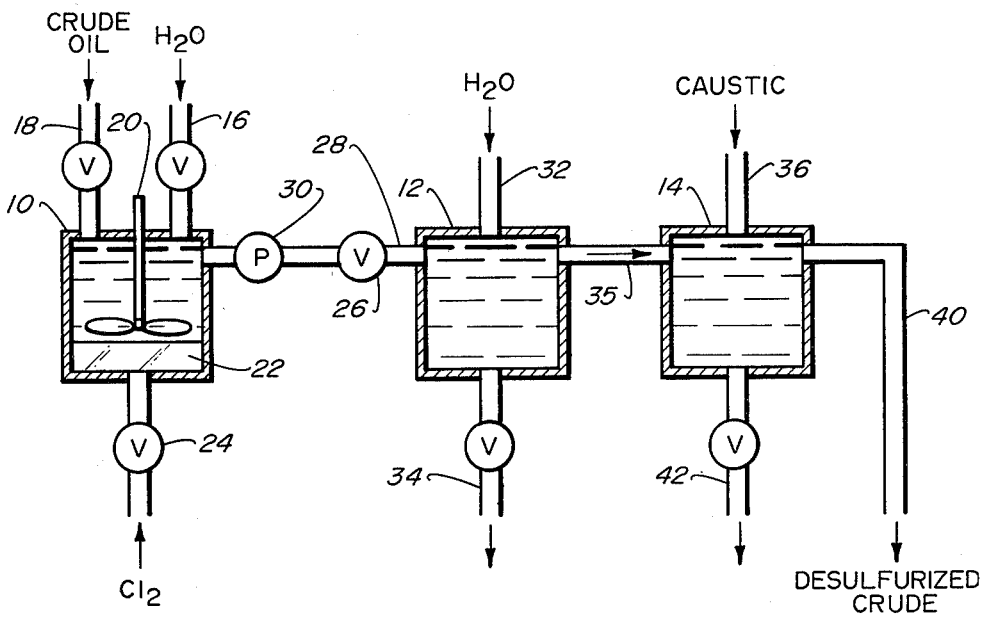
FIG. 1 is a schematic view of a crude oil desulfurization system in accordance with this invention.

Referring now to FIG. 1, the desulfurization system generally includes a chlorinolysis unit 10, water washing unit 12 and caustic washing unit 14. Water and crude oil are fed to the chlorinolysis unit 10 from lines 16 and 18 respectively in the desired ratio, usually 0.3 $H_2O$/oil, by volume. The streams are at ambient or can be preheated to the desired temperature. Stirrer 20 is started and chlorine is fed to fritted glass bubbler 22 at the bottom of the unit. At the end of the desired reaction period, valve 24 is closed, valve 26 is opened and the brown emulsion is pumped through line 28 by means of pump 30 into unit 12.

An excess amount of water, usually 4/1 water to oil is added to the emulsion through line 32 and removed through drain 34 and discarded after the supernatent oil has been transferred through line 35 into unit 14. An excess amount of dilute caustic, usually 4/1 caustic (1 molar) to oil at is then added to unit 14 through line 36. Desulfurized crude is recovered at 40 and spent caustic is discarded through drain 42.

Figure 2:
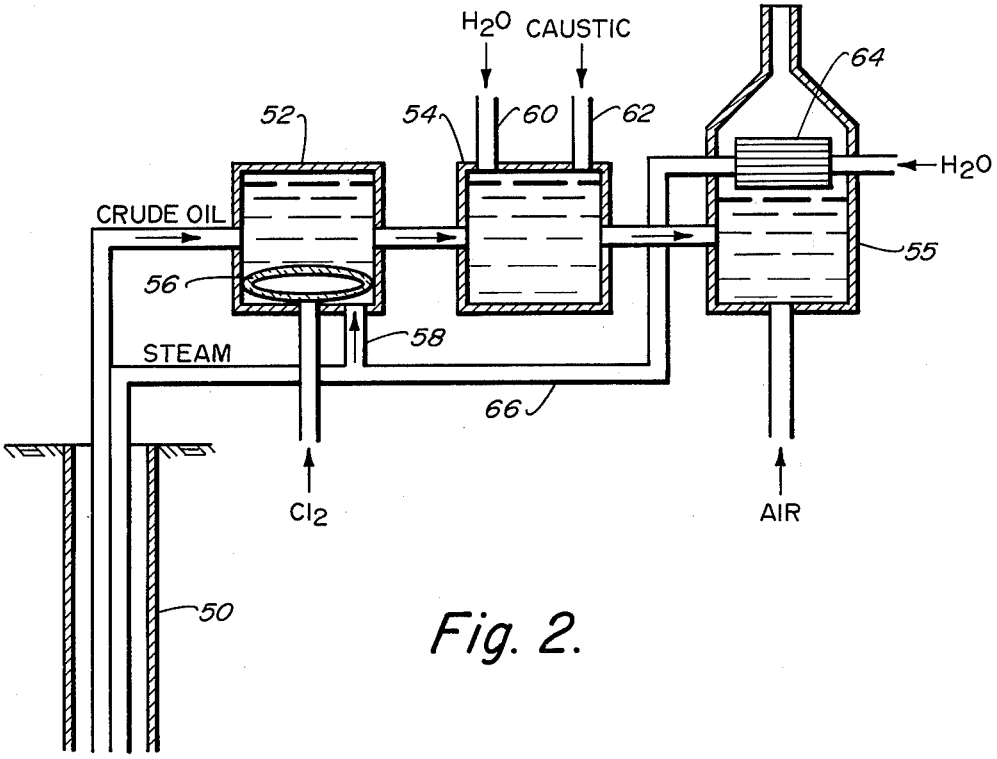
FIG. 2 is a schematic view of a well-site desulfurization system.

Referring now to FIG. 2, the well-site system includes a recovery well 50, chlorinolysis unit 52, washing unit 54, and steam generator 55. Crude oil recovered from the well 50 is delivered to chlorinolysis unit 52. $Cl_2$ is bubbled into the oil from a perforated ring bubbler 56 and steam is injected into the oil from line 58. The chlorine treated oil is then delivered to washing unit 54 in which it is successively washed with water and caustic from lines 60 and 62 respectively.

A portion of the desulfurized oil is then fed to the combustion section of steam generator 55 along with air and the combustion gases generate steam in tube bank 64. The generated steam is recycled to chlorinolysis unit 52 and well 50 through lines 58 and 66.

EXAMPLE 1

A series of experiments were carried out at temperatures from 25° C. to 80° C. for periods from 0 to 120 minutes on a crude petroleum oil containing 1% sulfur obtained from the Brea-Olinda field of Union Oil Co. Chlorine was introduced at a rate of 5 grams of $Cl_2$/100 grams of oil/hour. The ratio of water to oil was 0.3.

In typical runs, about 230 grams of petroleum was stirred in a glass flask fitted with a stirrer and fritted gas bubbler. Either at room temperature, or upon pre-heating to the stated temperature, a vigorous degree of stirring was initiated, and chlorine then introduced to the lowest portion of the flask for up to one hour. A brown emulsion resulted. This product was washed with a four-fold amount of water, and the water then separated. The oily layer showed very little fluidity decrease. Thereafter the washed oil was further mixed and washed with a four-fold quantity of sodium hydroxide (1 molar). The final oil was analyzed and fractionally distilled for characterization.

Significant desulfurization is experienced at treatment periods as little as 15 minutes with optimum treatment appearing to be at 60 minutes. EPA requirement of 0.3% sulfur is achieved at room temperature in 60 minutes, though more efficient desulfurization occurs at 50° C. The process of the invention provides low cost, efficient desulfurization readily adapted to the on-site generation of process heat or steam for EOR from oil wells.

It is to be understood that only preferred embodiments of the invention have been described and that numerous substitutions, modifications and alterations are permissible without departing from the spirit and scope of the invention as defined in the following claims.

We claim:

1. A method of reducing the sulfur content of a crude petroleum oil containing from 0.5 to 3% sulfur by at least 50% comprising the steps of:

bubbling molecular chlorine gas through the oil in the presence of water at a temperature from 25° C. to 85° C. at ambient pressure for at least 5 minutes, the ratio of water to oil being from 0.05/1 to 0.5/1;

washing the oil to remove sulfur and chlorine containing reaction products; and recovering a desulfurized oil.

2. A method according to claim 1 in which chlorine gas is bubbled through the oil at a rate of 1 to 100 grams of $Cl_2$/100 grams oil/hour.

3. A method according to claim 2 in which the treated oil is washed with at least an equal volume of water followed by washing with at least an equal volume of caustic having a molarity from 0.1 to 2.

4. A method of enhancing the recovery of oil from a well comprising the steps of:

recovering crude petroleum oil containing sulfur from a well;

treating the oil at the well site with molecular chlorine gas in the presence of water;

washing the oil to remove sulfur and chlorine reacting products;

recovering a desulfurized oil;

feeding the recovered desulfurized oil to a boiler;

burning the oil to produce steam; and injecting the steam into the well to enhance the recovery of oil by steam flooding.

* * * * *